United States Patent [19]

Marmillion et al.

[11] Patent Number: 4,479,689

[45] Date of Patent: Oct. 30, 1984

[54] COUPLING NUT FOR AN ELECTRICAL CONNECTOR

[75] Inventors: David J. Marmillion, Bainbridge; Robert W. Brush, Sr., Unadilla, both of N.Y.

[73] Assignee: Bendix Corporation, Southfield, Mich.

[21] Appl. No.: 430,892

[22] Filed: Sep. 30, 1982

[51] Int. Cl.[3] ..... H01R 13/629

[52] U.S. Cl. ..... 339/89 M; 339/89 R

[58] Field of Search ..... 339/89 R, 89 C, 89 M, 339/90 R, 90 C, DIG. 2; 285/86, 89, 92

[56] References Cited

U.S. PATENT DOCUMENTS

| | | | |
|---|---|---|---|
| 1,349,518 | 8/1920 | Lyle | 285/89 |
| 3,605,069 | 9/1971 | Dorrell | 339/90 R |
| 3,869,186 | 3/1975 | Vetter | 339/89 R |

FOREIGN PATENT DOCUMENTS

| | | | |
|---|---|---|---|
| 1942209 | 4/1970 | Fed. Rep. of Germany | 339/89 M |
| 2025821 | 4/1980 | Fed. Rep. of Germany | 339/89 M |

*Primary Examiner*—John McQuade
*Attorney, Agent, or Firm*—C. D. Lacina

[57] ABSTRACT

A coupling nut (300) mounted to a first shell (100) for connection to a threaded second shell (200) comprises: an operating sleeve (600) rotatably circumposing inner front and rear coupling sleeves (400, 500) having their adjacent ends threadedly interconnected; a roll bar (700) operatively driven by operating sleeve (600) for engaging spaced end faces on respective coupling sleeves to cause relative rotation therebetween; and a coil spring (800) for constantly biasing the coupling sleeves (400, 500) into a first position, right-handed thread (220, 420) operating between second shell (200) and front coupling sleeve (400) and left-handed thread (430, 530) operating between the coupling sleeves (400, 500), coupling rotation beyond mating engagement between the assembly by the right-handed threads causing coil spring (800) to compress and transmit uncoupling rotation to the left-handed threads whereupon the coupling sleeves separate and further coupling rotation of the right-handed thread, uncoupling rotation of the front coupling sleeve having the right-handed thread simultaneously causing the coil spring to urge the separated rear coupling sleeve with left-right-handed thread into the coupling direction towards the front coupling sleeve to maintain and tighten the grip between the right-handed thread.

12 Claims, 13 Drawing Figures

FIG. 1
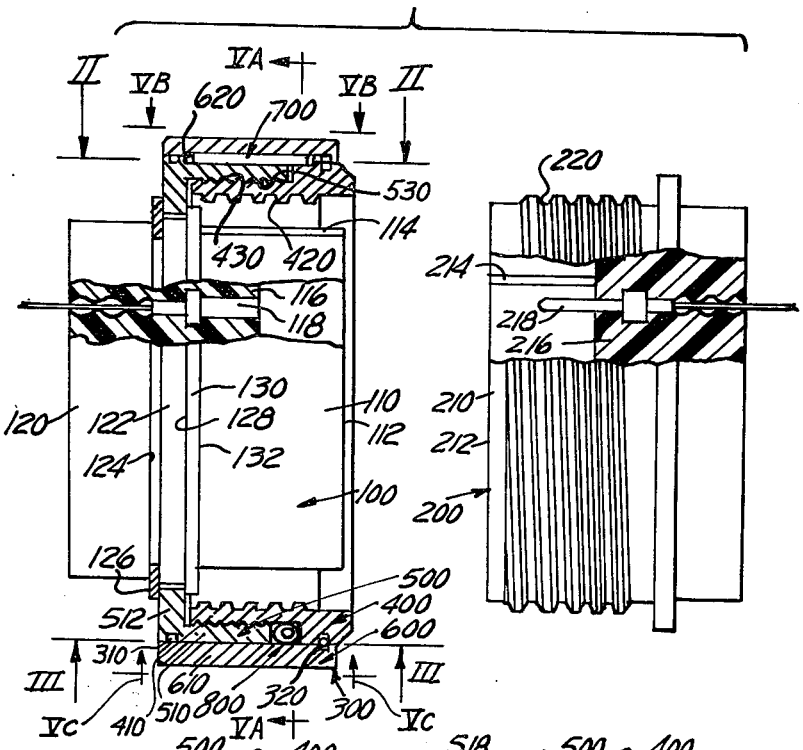
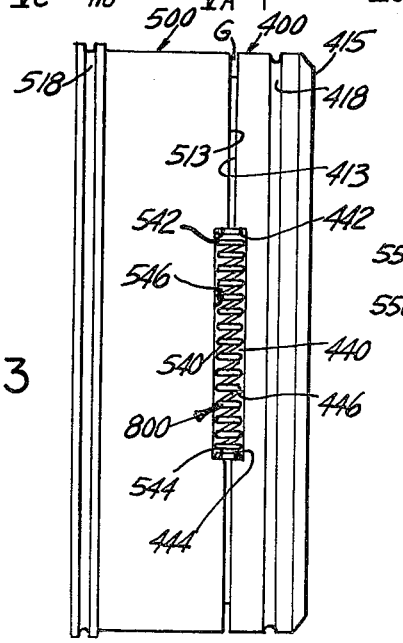
FIG. 3
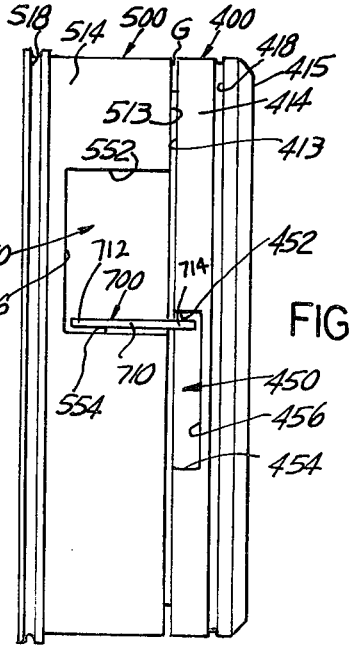
FIG. 2

UNCOUPLED POSITION

COUPLED POSITION

UNCOUPLING

COUPLING NUT FOR AN ELECTRICAL CONNECTOR

This invention relates to a coupling nut for an electrical connector and more particularly to a compound coaxial coupling nut comprising an operating sleeve rotatably circumposed about threadedly connected coupling sleeves and wherein a roll bar transmits coupling/uncoupling torques to first and second threads to tighten the interconnection.

Electrical connector assemblies are generally comprised of two separate housings and a coupling member rotatably mounted to one of the housings by means of a retaining ring captivating a radial flange of the coupling member against an annular shoulder of the one housing, each housing having electrical contacts carried therewith the contacts of one housing being matable with contacts in the other housing when the two housings are connected together by the coupling member, coupling engagement resulting from sliding rotational movement between thread formed on the coupling member and on the outer portion of the connector member. Without more, the coupling member is held in engagement solely by friction between the engaged thread surfaces. Because some clearance must be provided between threads formed, it is not uncommon to find that the coupling member will tend to loosen under vibrational influences.

Provision of more or fewer threads to increase surface engagement has its own problems. Relatively blunt thread allows speed of coupling and offers some resistance to debris interfering with coupling rotation but limits thread number and does not optimize the amount of thread surface. On the other hand, a great number of relatively fine thread would increase the thread surfaces contacted but would be costly to form, would not rapidly allow parts to be coupled and would be subjected to debris frustrating coupling/uncoupling. Further, fine thread possibly might require lubrication which would thus frustrate reliance on friction forces to resist uncoupling.

A desirable connector assembly would include an anti-decoupling device which would utilize the theaded engagement to hold the coupling nut and the connector housings in place, but yet which would allow the coupling member to be disconnected upon application of reasonable uncoupling torques applied by the user. Various anti-rotation devices to prevent unwanted back-off and/or disconnection of a coupling member are known.

In "Electrical Connector Assembly Having An Anti-Decoupling Mechanism," U.S. Pat. No. 4,109,990 issuing Aug. 29, 1972 to Waldron et al, a straight spring beam has its ends mounted to a coupling nut and includes a medial tooth member co-acting with ratchet teeth disposed around an annular shoulder extending from the connector shell. In many applications requiring protection from radio frequency interference (RFI), metal-to-metal contact between mated connector shells is absolutely necessary. However, some vibration environments will cause the straight spring beam with its tooth to allow back-off between ratchet teeth of perhaps one ratchet click and the connector shells to undergo axial back-off from their metal-to-metal contact. This back-off during high vibrational levels results in severe hammering of the connector components resulting in accelerated contact wear and electrical continuity between mated electrical contacts to drop to unacceptable levels. Actual impact of the hammering components transmits high level energy stress peaks to critical stress areas and the components fail due to material fatique. If the connector shells are rigidly held fixed together in metal-to-metal contact by the coupling nut during this severe vibration, the connector assembly will act as one continuous body with more strength than any of its components.

A desirable connector assembly would include means for axially tightening the components at full mate.

This invention promotes tightening of a coupling nut relative to its associated plug shell after a connectable receptacle shell has achieved full mate (metal-to-metal contact) with the plug shell. More specifically, the coupling nut is mounted to the plug shell for rotation thereabout and comprises: three co-rotatable sleeves coaxially disposed about the plug shell, the sleeves including an outermost operating sleeve having a longitudinal groove circumposing a pair of coupling sleeves having their adjacent ends connected in tandem by second thread for axial movement upon relative rotation therebetween, each coupling sleeve including spaced end faces with a front coupling sleeve having first thread operating between the receptacle shell and a rear coupling sleeve having a radial flange for mounting to the plug shell; a roll bar rollably operating between the operating sleeve and the coupling sleeves, the bar being disposed within the longitudinal groove and in each of the angular undercuts; and a helical coil spring operating between the coupling sleeves to constantly urge the coupling sleeves into one position, the operating sleeve being adapted to drive the roll bar between the opposite end faces of the angular undercuts to thereby transmit torques to cause the coupling sleeves to undergo relative rotation. The first thread formed between the coupling nut and the receptacle shell is right-handed thread and the second thread formed between the coupling sleeves is left-handed thread and/or vice versa, to allow axial separation therebetween upon engagement of the first thread and relative coupling rotation between the coupling sleeves. Coupling rotation of the operating sleeve advances the coupling sleeves together as a unit to full mate. Because of right-handed thread for coupling and left-handed thread between the coupling sleeves, further coupling rotation of the operating sleeve from full-mate drives the rear coupling sleeve axially away from the front coupling sleeve and conpresses the bias means. Uncoupling rotation of the front coupling sleeve would tend to advance both coupling sleeves rearwardly as a unit but due to constant bias from the coil spring and the left-handed thread the rear coupling sleeve is constantly biased to rotate forwardly in the coupling direction to tighten the axial contact between the first threads.

One advantage of this invention is effective utilization of stored forces of a compression spring and of mechanical means (left/right-handed threads) cooperating to provide a clamping force between plug and receptacle shells at all times when coupled to prevent uncoupling during vibration.

Left-handed thread between the coupling sleeves provides a secondary mechanical advantage over the right-handed thread on the coupling nut. The compression spring provides a force to maintain mechanical advantage of the left-hand thread between inner coupling sleeves when the connector shells are fully mated. The roll bar is held fixed relative to the operating sleeve to transmit external coupling torques applied to the operating sleeve directly to the outer of the coupling sleeves taking advantage of the secondary mechanical advantage of the left-hand thread and to provide force to the compression spring during mating. The roll bar also transmits external uncoupling torques applied to the operating sleeve directly to the inner of the coupling sleeves, overriding the mechanical advantage of the left-hand thread and maintaining the force of compression during unmating.

One way of carrying out the invention as described below with reference to the drawings which illustrate one specific embodiment of this invention, in which:

FIG. 1 is a side view, partially in section, of an electrical connector assembly having a coupling nut.

FIG. 2 is a view taken along lines II—II of the coupling nut in FIG. 1.

FIG. 3 is a view taken along line III—III of the coupling nut of FIG. 1.

Figure 5B:
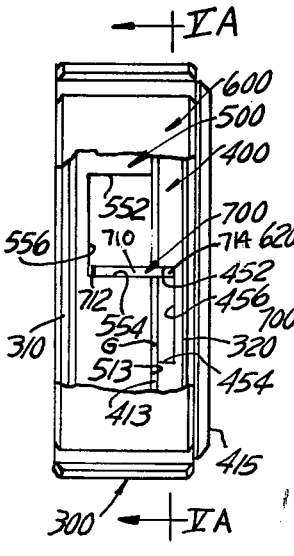
Figure 5A:
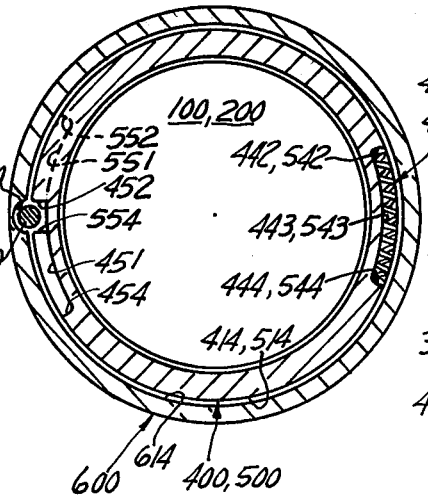
Figure 5C:
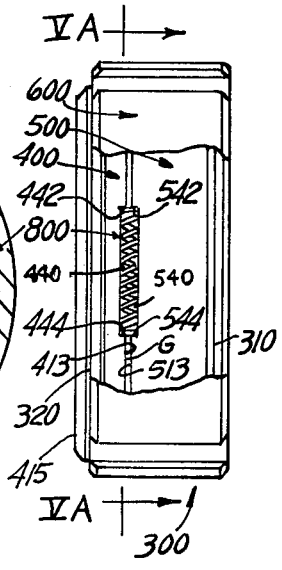

FIGS. 5A, 5B and 5C show, in three different views, the coupling nut of FIG. 1 without the electrical connector assembly and in its uncoupled position. FIG. 5A is a front section view taken along lines VA—VA. FIG. 5B is a top view taken along lines VB—VB looking down on the coupling nut having a portion thereof partially cut away. FIG. 5C is a bottom view looking upward, partially cut away, taken along lines VC—VC. FIG. 5A is also as seen as taken along lines VA—VA of FIGS. 5B and 5C.

Figure 6B:
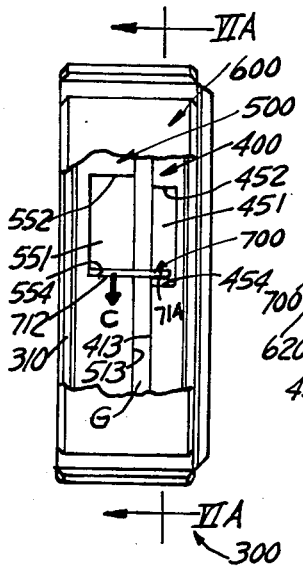
Figure 6A:
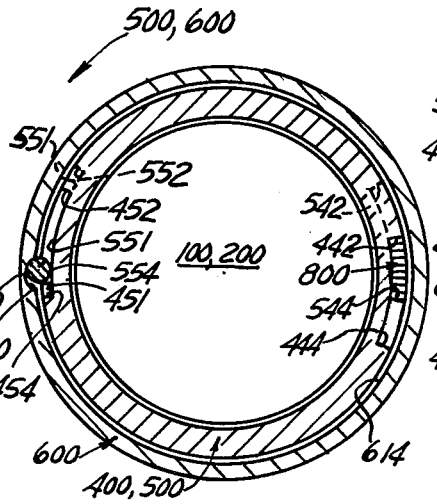
Figure 6C:
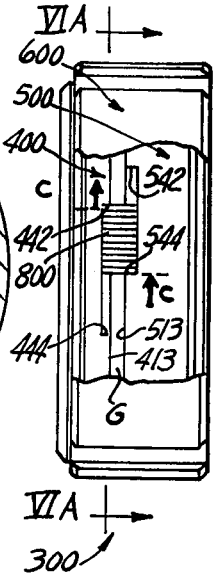

FIGS. 6A, 6B and 6C show, in three different views, the coupling nut of FIG. 1 without the electrical connector assembly and in its coupled position, each of the instant FIGS. 6A, 6B and 6C corresponding, respectively, to the views taken along lines VA—VA, VB—VB and VC—VC. FIG. 6A is also as seen along lines VIA—VIA of FIGS. 6B and 6C.

Figure 7B:
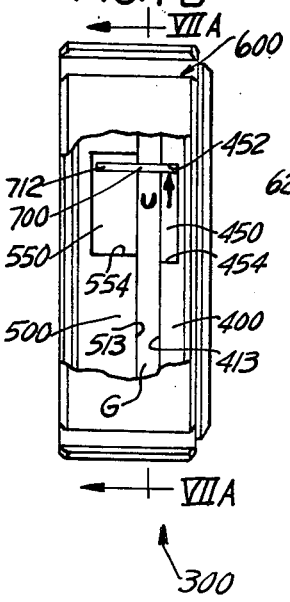
Figure 7A:
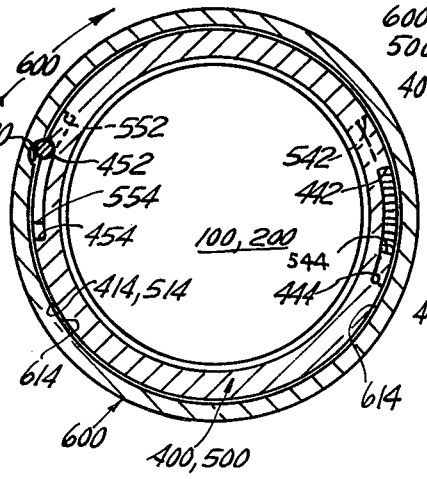
Figure 7C:
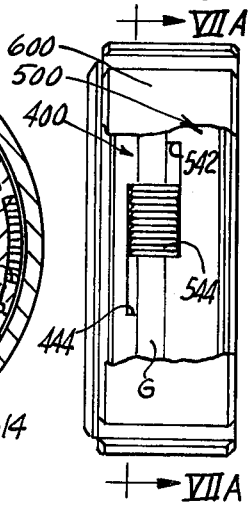

FIGS. 7A, 7B and 7C show, in three different views, the coupling nut of FIG. 1 as it would appear without the electrical connector assembly and undergoing uncoupling rotation, each of the instant FIGS. 7A, 7B and 7C corresponding, respectively, to the views taken along lines VA—VA, VB—VB, and VC—VC. FIG. 7A is also as seen taken along lines VIIA—VIIA of FIGS. 7B and 7C.

Referring now the the drawings and FIG. 1 in particular, an electrical connector assembly includes matable first and second connector shells 100, 200 positioned for mating engagement in end-to-end relation along their center axis and a coupling nut 300 coaxially mounted for rotation to first shell 100 for connecting the first shell and second shell in mating relationship.

The first shell 100, also considered a plug-type connector, includes a cylindrical front portion 110 having a front face 112, a rear portion 120 and an annular shoulder 130 medially of shell portions 110, 120, rear portion 120 including an annular wall 122 circumjacent the annular shoulder and a stepped groove 124, the annular shoulder 130 including a front face 132 and a rear face 128. The outer surface of front portion 110 would include one or more longitudinally extending axial keys 114 for orienting first shell 100 relative to second shell 200. The first shell includes a dielectric insert 116 and one or more female-type (i.e., socket) electrical contacts 118 mounted therewithin.

The second shell 200, also considered a receptacle-type connector, includes a front portion 210 having a front face 212 and external thread 220 on the outside surface thereof. Further, shell 200 includes one or more longitudinally extending axial recesses or key-ways 214 for receiving a respective key 114 on first shell 100 and one or more male-type (i.e., pin) electrical contacts 218 that mate within the socket-type contacts 118 disposed in first shell 100, the pin contacts 218 being retained within a dielectrical insert 216 mounted within the receptacle shell. Of course, the pin/socket contacts 218, 118 could be other than shown.

Coupling nut 300 is rotatably mounted on first shell 100 by means of an inwardly extending radial flange 512 being circumposed about annular wall 122 and captivated for rotation against rear face 128 of annular shoulder 130, radial flange 512 being captivated adjacent the annular shoulder by a retaining ring 126 being received within stepped groove 124.

Preferably and in accord with this invention, coupling nut 300 is a compound coupling member which comprises three coaxial cylindrical sleeves 410, 510 and 610 mounted for rotation relative to one another and relative to the assembly between plug and receptacle shells 100, 200, the coupling nut comprising an operating sleeve 600 circumposing a coupling structure comprising front and rear coupling sleeves 400, 500 having their adjacent ends connected in tandem and axially separable upon relative rotation therebetween.

Figure 4:
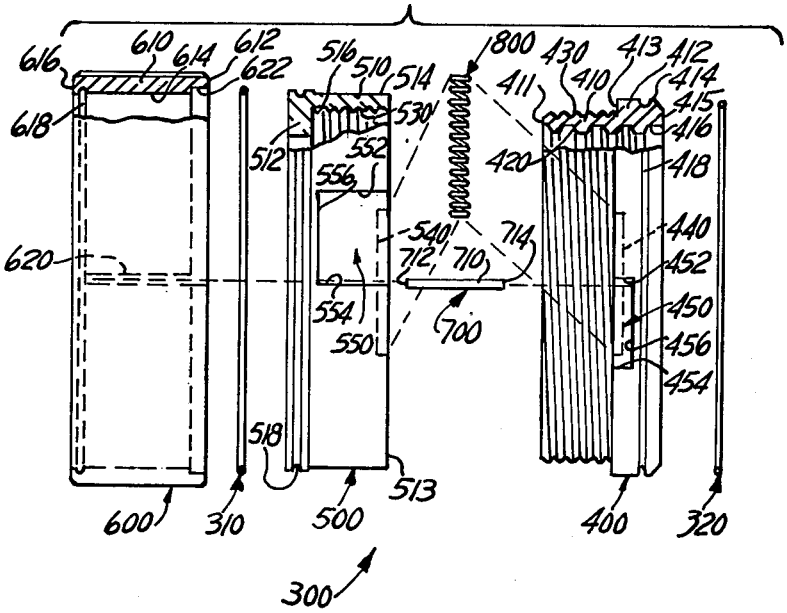
FIG. 4 is an exploded view, partially in section, of the coupling nut according to the present invention.

Rear coupling sleeve 500 includes inward radial flange 512 and cylindrical shell 510 with cylindrical shell 510 having left-handed thread 530 on its inner wall 516 (see FIG. 4). Front coupling sleeve 400 includes cylindrical shell 410 with cylindrical shell 410 having right-handed thread 420 on its inner wall 416 (see FIG. 4) and left-handed thread 430 on an external portion thereof, the internal right-handed thread 420 being complementary to and adapted to mate with the external right-handed thread 220 on receptacle shell 200. The left-handed external and internal thread 430, 530 disposed on the front and rear coupling sleeves 400, 500 are adapted to threadably engage with one another to interconnect the two coupling sleeves in tandem. The operating sleeve 600 includes cylindrical shell 610, the shell having a longitudinal groove 620 therein and being mounted to the coupling sleeves, respectively, by an O-ring 310 and a annular retaining wire 320. A straight roll bar 700 is interposed between operating sleeve 600 and coupling sleeves 400, 500 such that the upper half of roll bar 700 is received in longitudinal groove 620 and the lower half of roll bar 700 is projecting radially inwardly from the operating sleeve and extending longitudinally between the coupling sleeves. A compression spring 800 for constantly biasing the respective coupling sleeves in contra-directions and into one position is received in a spring cavity formed between confronting abutment faces 413, 513 (see FIG. 3) of coupling sleeves 400, 500.

Preferably the total amount of right-handed thread surfaces contacting would be greater than the total amount of left handed thread surfaces contacting. The right-handed thread 420, 220 would be triple starting thread forming "blunt" but rapidly connectable thread parts. The left-handed thread 430, 530 would be relatively "fine" to provide vise-like mechanical advantage. In one embodiment, the right-handed thread 420, 220 was "Acme" Class 2B and included perhaps 8 threads per inch and the left-handed thread 430, 530 was metric, Class 2A, double start.

FIG. 2 shows front and rear coupling sleeves 400, 500 having adjacent ends threadably connected together in tandem. Front coupling sleeve 400 includes the abutment face 413, a front face 415 and outer surface 414 having an annular groove 418 and an angular undercut 450, the angular undercut 450 defining angularly spaced end faces 452, 454 and an end wall 456 spaced inwardly from abutment face 413, the annular groove 418 being sized to receive annular retaining wire 320 therewithin. Rear coupling sleeve 500 includes the abutment face 513 and outside surface 514 having an annular groove 518 and an angular undercut 550, the angular undercut 550 defining angularly spaced end faces 552, 554 and an end wall 556 spaced inwardly from abutment face 513, the annular groove 518 being sized to receive O-ring 310 therewithin. Roll bar 700 comprises a straight cylindrical body 710 having opposite end portions 712, 714 disposed, respectively in angular undercuts 450, 550.

As shown, a small axial separation, indicated by the letter "G", exists between abutment faces 413, 513. To be described later, axial separation between the coupling sleeves 400, 500 increases during coupling whereby spring 800 is compressed to maintain tightened clamping contact between first thread 420, 220 operating between the coupling nut and receptacle shell.

FIG. 3 shows coupling sleeves 400, 500 of FIG. 2 rotated 180° and the spring cavity being formed between confronting spring housings 440, 540 disposed in the respective coupling sleeves and receiving helically coiled compression spring 800, spring housing 540 extending inwardly of abutment face 513 and including spaced spring seats 542, 544 and a spring wall 546 and spring housing 440 extending inwardly of abutment face 413 and having spaced spring seats 442, 444 and a spring wall 446.

FIG. 4 shows coupling nut 300 in exploded relation and comprises outer coupling sleeve 600, O-ring 310, rear coupling sleeve 500, roll bar 700, compression spring 800, front coupling sleeve 400 and annular retaining wire 320. Operating sleeve 600 comprises cylindrical shell 610 having inner wall 614 and front and rear faces 612, 616, the inner wall having an annular undercut 622 to assist assembly with rings 310, 320, an annular groove 618 to cooperate with annular groove 518 to seat O-ring 310 therebetween and the longitudinal groove 620 extending substantially the length of the operating sleeve. The O-ring 310 is adapted to provide moisture resistance to the assembly when formed.

Rear coupling sleeve 500 includes cylindrical shell 510 having inner and outer walls 516, 514, radial flange 512 and the abutment face 513, the left-handed thread 530 being formed on inner wall 516. Front coupling sleeve 400 includes cylindrical shell 410 having front and rear faces 415, 411, an annular shoulder 412 adjacent front face 415 and defining the abutment face 413, the right-handed thread 420 being formed on inner wall 416, left-handed thread 430 being formed on an outside wall and the annular groove 418 being disposed in outer surface 414 of annular shoulder 412, annular groove 418 being disposed thereabout for cooperating with annular undercut 622 to captivate annular retaining wire 320 therebetween.

Angular undercuts 450, 550 are adapted to be off-set one to another and spring housings 440, 540 (shown in phantom) in confronting relation. Roll bar 700 comprises the generally cylindrical pin 710 having opposite ends 712, 714 thereof adapted to extend between the end walls 456, 556 of the angular undercuts 450, 550.

FIGS. 5A, 5B and 5C show coupling nut 300 in its uncoupled position such as it would appear in FIG. 1 and from each of three views when mounted to first shell 100 for coupling with second shell 200, the connector shells 100, 200 being omitted for clarity. FIG. 5A is a front section view of the coupling nut and FIGS. 5B and 5C are diametrical side views of the coupling nut having portions partially cut away to show interior detail. Connector shells 100, 200 of the connector assembly have been omitted for clarity. In FIG. 5A, roll bar 700 is rollably received within longitudinal groove 620 such that the upper portion of the bar is disposed in the groove and the lower portion of the bar is disposed on roll surfaces 551, 451 defined by the angular undercuts 550, 450, the roll bar being adjacent end faces 554, 452 of angular undercuts 550, 450. As shown, radial clearance is provided between roll surfaces 551, 451 and inner wall 614 of operating sleeve 620 to allow uniform rolling motion of roll bar 700 between the end faces 554, 552; 452, 454 of the respective angular undercuts 550, 450. Coil Spring 800 is received about end walls 443, 543 and between the spring seats 442, 542 and 444, 544. In FIG. 5B, roll bar 700 is positioned to have its straight body 710 extend between the coupling sleeves whereby axial end portions 712, 714 of the bar abut angular end faces 452, 554 and opposite ends confront, respectively, end walls 456, 556. An axial gap "G" exists between abutment faces 513, 413. In FIG. 5C, spring housings 540, 440 are in register such that spring seats 544, 444 and 542, 442, respectively, captivate coil spring 800 therebetween.

FIGS. 6A, 6B and 6C show coupling nut 300 in its coupled position corresponding, respectively, to each of the three views of FIG. 5. In the coupled position an increased axial separation "G" developes between abutment faces 513, 413 of the inner coupling sleeves. FIG. 6A is a front section view of the coupling nut and FIGS. 6B and 6C are diametrical side views having portions partially cut-away to show interior detail. In FIG. 6A, coupling rotation of operating sleeve 600 is indicated by the counter-clockwise arrow associated with number "500, 600". During coupling rotation operating sleeve 600 drives roll bar 700 within longitudinal groove 620 against end face 554 of rear coupling sleeve 500. Initially, the coil spring will not compress and the three sleeves are constrained to rotate as a unit. Upon full engagement of right-handed thread 420, 220, the spring seats 442, 544 compress spring 800 therebetween and transmit torque from operating sleeve 600 to rear coupling sleeve 500 to constrain operating sleeve 600 and rear coupling sleeve 500 to rotate as a unit relative to front coupling sleeve 400. As a result of this rotation, end face 554 of angular undercut 550 rotates towards end face 454 of angular undercut 450. Coil spring 800 remains compressed between spring seats 442, 544. In FIG. 6B, operating sleeve 600 transmits torque in the form of a coupling force, designated by "C", placed against roll bar 700, the roll bar being constrained to rotate within longitudinal groove 620 of operating sleeve 600. In FIG. 6C, the coupling force "C" is transmitted from rear coupling sleeve 500 to front coupling sleeve 400 by compression of spring 800 by spring seats 544, 442.

FIGS. 7A, 7B and and 7C show uncoupling of the coupling nut, FIG. 7A generally being an end view as would be seen taken along lines VII—VII of FIGS. 7B and 7C. In FIG. 7A, during uncoupling rotation, operating sleeve 600 rotates clockwise as shown by the arrow associated with "600" and groove 620 drives roll bar 700 across angular undercuts 450, 550 and into abutment with end face 452 of front coupling sleeve 400. In FIG. 7B, operating sleeve 600 transmits torque in the form of an uncoupling force designated by "U", against roll bar 700 and to end face 452 of front coupling sleeve 400, the torque being transmitted through spring 800 to rear coupling sleeve 500 breaking the left-handed threads 530, 430 from frictional engagement and then the right-handed threads 420, 220 from engagement. Further rotation of operating sleeve 600 causes complete uncoupling separation whereupon the coil spring 800, forced against the spring seats of the spring housings 440, 442, restores the coupling sleeves to the their original FIG. 5 uncoupled position.

OPERATION

Coupling nut 300 of this invention retains plug and receptacle shells 100, 200 together in metal-to-metal contact by tightening binding friction operating between right-handed thread 420, 220 on front coupling sleeve 400 and receptacle shell 200.

Coupling torque applied to the operating sleeve 600 is transmitted through roll bar 700 to end face 554 of rear coupling sleeve 500 and then through compression spring 800 to front coupling sleeve 400. Rotation resisting forces (e.g., thread friction) during normal coupling rotation is inadequate to compress spring 800 and thus the coupling sleeves 400, 500 rotate as a unit with the operating sleeve 600. When full axial travel of coupling nut 300 has been achieved, shells 100, 200 are at full mate wherein end face 212 of receptacle shell 200 is metal-to-metal contacting front face 132 of plug shell 100 and end wall of radial flange 512 is tightly contacting rear face 128 of the plug shell shoulder 130 and preventing front coupling sleeve 400 from advancing further relative to right handed thread 420, 220. Thereafter, as shown in FIGS. 6A and 6B, roll bar 700 continues to drive against end face 554 of rear coupling sleeve 500 and, as shown in FIGS. 6A and 6C, the spring seats 442, 544 advance towards one another to compress spring 800 therebetween with the left-handed thread 430, 530 causing rear coupling sleeve 500 to undergo relative separating rotation rearwardly and away from front coupling sleeve 400. Simultaneously, compression in spring 800 transmits coupling force to front coupling sleeve 400 and the right-handed thread 420, 220 allows the front coupling sleeve 400 to rotate forwardly relative to receptacle shell 200. The relative axial separation distance "G" measured between abutment faces 413, 513 of coupling sleeves 400, 500 is increased and the spring 800 compressed. Coupling torque from operating sleeve 600 allows front coupling sleeve 400 to be rotated into the coupling direction (i.e., driven axially towards receptacle shell) and rear coupling sleeve 500 to retract axially (i.e., driven axially away from receptacle shell) and away from front coupling sleeve 400. Upon release of the mating torque, the spring 800 acts to drive rear coupling sleeve 500 in the coupling direction to simultaneously develop a tight grip between thread surfaces and between flange 512 and annular shoulder 130 of plug shell 100.

If the connector components should loosen during severe vibration then the force stored in compression spring 800 biases rear coupling sleeve 500 in a coupling direction relative to the front coupling sleeve 400 and receptacle shell 200, constantly driving the flange 512 into abutment with annular shoulder 130 and thus tightening the axial clamping pressure on the right-handed thread.

In order to uncouple the assembly, operating sleeve 600 is rotated in the uncoupling direction (shown best in FIG. 7A) and uncoupling force "U" applied against roll bar 700 pushes against end face 452 of front coupling sleeve 400 and left-handed thread 430, 530 breaks loose and, upon further rotation of operating sleeve, the right-handed thread 420, 220 breaks loose to disengage from the receptacle shell, bias spring 800 returning the compound coupling nut to its uncoupled position (as shown in FIGS. 5A, 5B and 5C).

Although the description of this invention has been given with reference to a particular embodiment, it is not to be construed in any limiting sense, many variations and modifications possibly occurring to those skilled in the art. For example the first and second thread 420, 220; 430, 530 could be of the same sense (i.e., right/left handed) for tightening in the same direction of rotation. Further, the connector assembly could include the straight spring beam/ratchet teeth arrangement as described in above referenced U.S. Pat. 4,109,990 to Waldron et al.

What is claimed is:

1. A coupling nut for an electrical connector of the type having first and second shells (100, 200), the coupling nut adapted to be rotatably mounted to the first shell (100) and adapted to be connected to the second shell (200) by engaging a pair of first threads (420, 220) operating between the second shell and the coupling nut, the coupling nut characterized by:

two coupling sleeves (400, 500) threadedly interconnected at respective adjacent ends by second threads (430, 530), said coupling sleeves being adapted to undergo axial movement upon relative rotation between said second threads to tighten engagement between the first threads, one of said coupling sleeves (400) including one said first thread (420) and said second threads (430, 530) being of opposite helical sense than said first threads (420, 220); and drive means (600, 700) for driving the coupling sleeves between first and second angular positions whereby said respective first and second threads undergo relative axial movement for tightening.

2. The coupling nut as recited in claim 1 wherein said first threads (420, 220) are right-handed and said second threads (430, 530) are left-handed.

3. The coupling nut as recited in claim 1, wherein said coupling sleeves (400, 500) include cylindrical shells (410, 510) having, respectively, abutment faces (413, 513) and outside surfaces (414, 514) with shell (410) being threadably fitted into shell (510) to have outside surfaces (414, 514) thereof exposed and abutment faces (413, 513) confronting, each of the outside surfaces including angular undercuts (450, 550) extending from their respective abutment faces (413, 513) with each angular undercut spacing first end faces (452, 552) from second end faces (454, 554) and said drive means (600, 700) comprising an operating sleeve (600) having an inner wall (614) circumposed for rotation about said outside surfaces (414, 514) and a bar (700) captivated by the operating sleeve, said bar projecting a lower portion thereof radially inward therefrom and adapted to engage respective of said end faces either singularly or simultaneously depending on the angular position of the operating sleeve.

4. The coupling nut as recited in claim 3, wherein said inner wall (614) of operating sleeve (600) includes a longitudinal groove (620) and said bar (700) comprises an elongated generally cylindrical body (710), said body having its upper portion rollably captivated within longitudinal groove (620) and its opposite ends (712, 714) extending, respectively, into said angular undercuts (450, 550), rotation of operating sleeve (600) rolling said bar (700) into engagement with respective end faces of the angular undercuts to rotate coupling sleeve (400) between first and second positions relative to coupling sleeve (500).

5. The coupling nut as recited in claim 1, characterized by: means (800) for constantly biasing said coupling sleeves (400, 500) into said first position.

6. The coupling nut as recited in claim 1, wherein said first and second threads (420, 220; 430, 530) comprise, respectively, blunt and fine type threads with said second threads including substantially greater thread per unit of advance than said first thread.

7. In an electrical connector assembly of the type having separable first and second shells (100, 200) and a threaded coupling nut (300) mounted to the first shell (100) and adapted to be threaded onto a forward portion (210) of the second shell (200) for connecting the shells together, the improvement characterized by:

mating first threads (420, 220) formed between said coupling nut (300) and said second shell (200);

said coupling nut (300) comprising a front coupling sleeve (400) and a rear coupling sleeve (500) with said coupling sleeves (400, 500) being threadedly interconnected at respective adjacent ends by mating second threads (430, 530), one of said coupling sleeves (400) including one of the first threads (420) with said second threads (430, 530) being of opposite sense than said first threads (420, 220) so that an external coupling torque applied to the one coupling sleeve (400) pulls the coupling nut axially towards the second shell (200) but applied to the other coupling sleeve (500) causes the other sleeve to axially retract from both the second shell and said one coupling sleeve; and bias means (800) transmitting external torques for constantly biasing the coupling sleeves into a first position and resisting relative rotation from said first position, external coupling torques on said coupling nut after engagement of said one coupling sleeve (400) with said second shell (200) causing said bias means (800) to transmit said coupling torques to said other coupling sleeve (500) and said other coupling sleeve to axially retract from the one coupling sleeve (400), the bias means (800) transmitting the external torque against the one coupling sleeve (400) and the one coupling sleeve to rotate towards the second shell (200) and thereby increase the amount of engagement between the first threads (420, 220).

8. The electrical connector assembly as receited in claim 7, wherein said coupling sleeves (400, 500) include angularly spaced first and second end faces (452, 554; 454, 552) and characterized by an operating sleeve (600) corotatably mounted about coupling sleeves (400, 500) and a bar (700) projecting inwardly from the operating sleeve, said bar being adapted to abut at least one end face of one coupling sleeve.

9. An electrical connector assembly of the type having mating first and second shells with the second shell having external first thread, and means including internal first thread for coupling the shells together, said coupling means being rotatably mounted to the first shell and adapted to couple the shells together by the first threads engaging, said coupling means being characterized by:

two coupling sleeves threadedly interconnected at respective adjacent ends by second threads with one of said two coupling sleeves being rotatably captivated to the first shell and the other coupling sleeve including said internal first thread, with said second threads being of opposite helical sense than said first threads so that the coupling sleeves axially separate from one another upon relative coupling rotation, said two coupling sleeves being adapted to undergo axial movement upon relative rotation between said second threads to tighten engagement between the first threads; and drive means for rotatably driving the coupling sleeves between first and second angular poitions whereby said respective first and second threads undergo relative axial movement for tightening.

10. The invention as recited in claim 9 wherein said first threads are right-handed and said second threads are left-handed.

11. The invention as recited in claim 10 wherein said coupling sleeves comprise cylindrical shells having, respectively, abutment faces and outside surfaces with shell being threadably fitted into shell to have outside surfaces thereof exposed and abutment faces confronting, each of the outside surfaces including angular undercuts extending from their respective abutment faces with each angular undercut spacing first end faces from second end faces and said drive means comprising an operating sleeve having an inner wall circomposed for rotation about said outside surfaces and a bar captivated by the operating sleeve, said bar projecting a lower portion thereof radially inward therefrom and adapted to engage respective of said end faces either singularly or simultaneously depending on the angular position of the operating sleeve.

12. The invention as recited in claim 11, wherein said inner wall of operating sleeve includes a longitudinal groove and said bar comprises an elongated generally cylindrical body, said body having its upper portion rollably captivated within longitudinal groove and its opposite ends extending, respectively, into said angular undercuts, rotation of operating sleeve rolling said bar into engagement with respective end faces of the angular undercuts to rotate coupling sleeve between first and second positions relative to coupling sleeve.

* * * * *